United States Patent [19]

Johnston

[11] Patent Number: 4,781,086

[45] Date of Patent: Nov. 1, 1988

[54] FLUID FITTING WRENCH

[75] Inventor: Lonnie E. Johnston, Bedford, Ohio

[73] Assignee: Crawford Fitting Company, Solon, Ohio

[21] Appl. No.: 15,352

[22] Filed: Feb. 17, 1987

[51] Int. Cl.[4] ..... B25B 23/14; B25B 13/16

[52] U.S. Cl. ..... 81/476; 81/164; 81/175; 81/186; 269/265; 269/249

[58] Field of Search ..... 81/303-308, 81/418, 424.5, 426, 426.5, 155, 467, 476, 473, 164, 175, 186, 176.1-176.3; 269/156, 249, 265, 257, 902

[56] References Cited

U.S. PATENT DOCUMENTS

| | | | |
|---|---|---|---|
| 50,748 | 0/1865 | Stilson et al. . | |
| 104,264 | 0/1870 | Butterfield . | |
| 135,882 | 0/1873 | Bonney . | |
| 221,633 | 0/1879 | Vinton . | |
| 564,442 | 0/1896 | Matthews . | |
| 729,508 | 5/1903 | Phillips . | |
| 793,412 | 6/1905 | Bliss . | |
| 804,008 | 11/1905 | Hopkins . | |
| 1,348,564 | 8/1920 | Evitis et al. . | |
| 1,415,440 | 5/1922 | Grein . | |
| 1,575,517 | 3/1926 | Albright et al. . | |
| 1,764,990 | 6/1930 | Schultz | 81/186 |
| 1,779,053 | 10/1930 | Stoner . | |
| 2,003,619 | 6/1935 | Williamson . | |
| 2,272,636 | 5/1940 | Dennis . | |
| 2,372,754 | 4/1945 | Wickens . | |
| 2,409,191 | 10/1946 | Brown . | |
| 2,506,373 | 5/1950 | McClain . | |
| 2,525,379 | 10/1950 | Smilansky . | |
| 2,953,796 | 9/1960 | Deviatka . | |
| 3,245,676 | 4/1966 | Floren et al. | 269/257 X |
| 4,041,811 | 8/1977 | Durant . | |

FOREIGN PATENT DOCUMENTS

| | | |
|---|---|---|
| 551634 | of 1921 | France . |
| 1003229 | of 1946 | France . |
| 111333 | of 1944 | Sweden . |

*Primary Examiner*—Debra Meislin

*Attorney, Agent, or Firm*—Fay, Sharpe, Beall, Fagan, Minnich & McKee

[57] ABSTRACT

An adjustable wrench particularly useful to facilitate ease of installation and removal of fluid fittings in and from a fluid system. The wrench includes an elongated handle threadedly cooperating with a body member. The body member has a pair of opposed clamping faces defining a clamping cavity adapted to receive an associated fitting. Relative rotation between the handle and body portion axially advances and retracts a smooth end face of the handle into and out of abutting engagement with a side wall of the fitting. A cutout region in the wrench body is adapted to receive one branch of an associated tee or cross type fluid fitting. The subject wrench readily facilitates clamping engagement of a fitting while coupling nuts are run up on or backed off of the fitting branches by conventional means.

7 Claims, 2 Drawing Sheets

FLUID FITTING WRENCH

BACKGROUND OF THE INVENTION

This invention pertains to the art of hand tools, and more particularly to an adjustable wrench type tool.

The invention is particularly applicable to an adjustable wrench for use with fluid fittings and will be described with particular reference to so called tee and cross type fluid fittings. However, it will be appreciated by those skilled in the art that the invention has broader applications and could also be used on other types of fittings and in many different environments.

Cross and tee type fluid fittings are designed to accommodate multiple inlet and outlet branches of a fluid system. Typically these inlet and outlet branches extend in generally perpendicular relation from a central body portion of the fitting. Oftentimes, fluid conduits are sealingly secured to the fluid fitting branches through use of coupling nuts and ferrules. The branches comprise necked-down portions of the fluid fitting, and each necked-down portion is externally threaded for cooperatively receiving an internally threaded coupling nut. Advancement of the coupling nuts onto the fitting branches as is known compresses the ferrules about the associated fluid conduits to sealingly conduct the conduits to the fitting.

As is expected, attaching the fluid conduits to the individual branches of the fluid fitting necessarily requires stabilization of the fitting. The coupling nuts may then be run up on or backed off of the associated branch by means of a conventional wrench. Heretofore, a pair of open-ended wrenches have been utilized in an effort to secure fluid conduits to multi-branch fluid fittings. A first open-ended wrench is secured to external wrench flats on the body portion of the fluid fitting while the second open-ended wrench is received on the desired coupling nut. The coupling nut is then run up on or backed off the externally threaded portion of the fitting branch by means of the second wrench while a user braces the remainder of the fluid fitting from rotation through use of the first wrench.

The foregoing arrangement has been found to be less than optimal since the open-ended wrenches are subject to slipping off of the fluid fitting. Although the first wrench is mated for engagement with the wrench flat surfaces on the fitting, there is no means to clampingly engage the wrench to the fitting. Further, the multi-branch arrangements are often located in hard to reach areas which complicates a secure bracing of the fitting. The required dexterity taken in conjunction with the forces necessary to tighten or loosen the coupling nuts require careful manipulation to prevent damage to the fluid system. If the fluid conduits are subject to bending or misalignment, the sealed relationship between the fitting and conduits may be disrupted.

Yet another problem associated with prior arrangements is found in the inability to accommodate various fluid fitting arrangements. Many prior wrench designs would not readily accommodate different fitting types or styles, e.g., tees and crosses without the need for alteration or difficult manipulations.

Still another problem associated with clamping type arrangements in general is that associated with overtightening. Prior arrangements have not adequately addressed this problem and as a result, fluid fittings were subject to overtightening at the time of installation.

Accordingly, it has been considered desirable to provide an adjustable wrench for fluid fittings that would securely brace fittings of different types, and include means to prevent overtightening. The present invention is believed to meet these needs in providing a tool which overcomes all of the above referred to problems and others. The subject invention provides a simple, economical wrench structure that is readily adjustable to various fluid fitting arrangements, and limits the potential for overtightening.

SUMMARY OF THE INVENTION

In accordance with the present invention, an adjustable fluid fitting wrench that facilitates adjustment of the coupling nuts in a multi-branch fitting arrangement is advantageously provided.

According to the invention, the adjustable wrench includes a handle having an actuating end and an opposed clamping end. The handle clamping end is received by a wrench body and mounted to selectively penetrate a portion of the body which is adapted to receive an associated fluid fitting therein. The body portion has first and second spaced side walls cooperable with peripheral portions of an associated fitting. These side walls and the handle clamping end facilitate a secure clamping of the fitting by the wrench.

According to another aspect of the invention, means for limiting the clamping forces on the associated fitting are provided. Preferably, the limiting means includes a handle grip designed to rotate relative to the handle at a predetermined force or torque level.

According to still another aspect of the invention, the wrench body includes a cutout region adapted to receive an orthogonally positioned fitting branch and thereby accomodates tee and cross type fittings.

A principal advantage of the invention is the provision of a new and improved adjustable wrench for fluid fittings.

Yet another advantage of the invention resides in an adjustable wrench usable with a variety of fitting arrangements and styles.

A still further advantage of the invention is realized in a new and improved wrench which is simple in design and easy to use.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figures 1, 3:
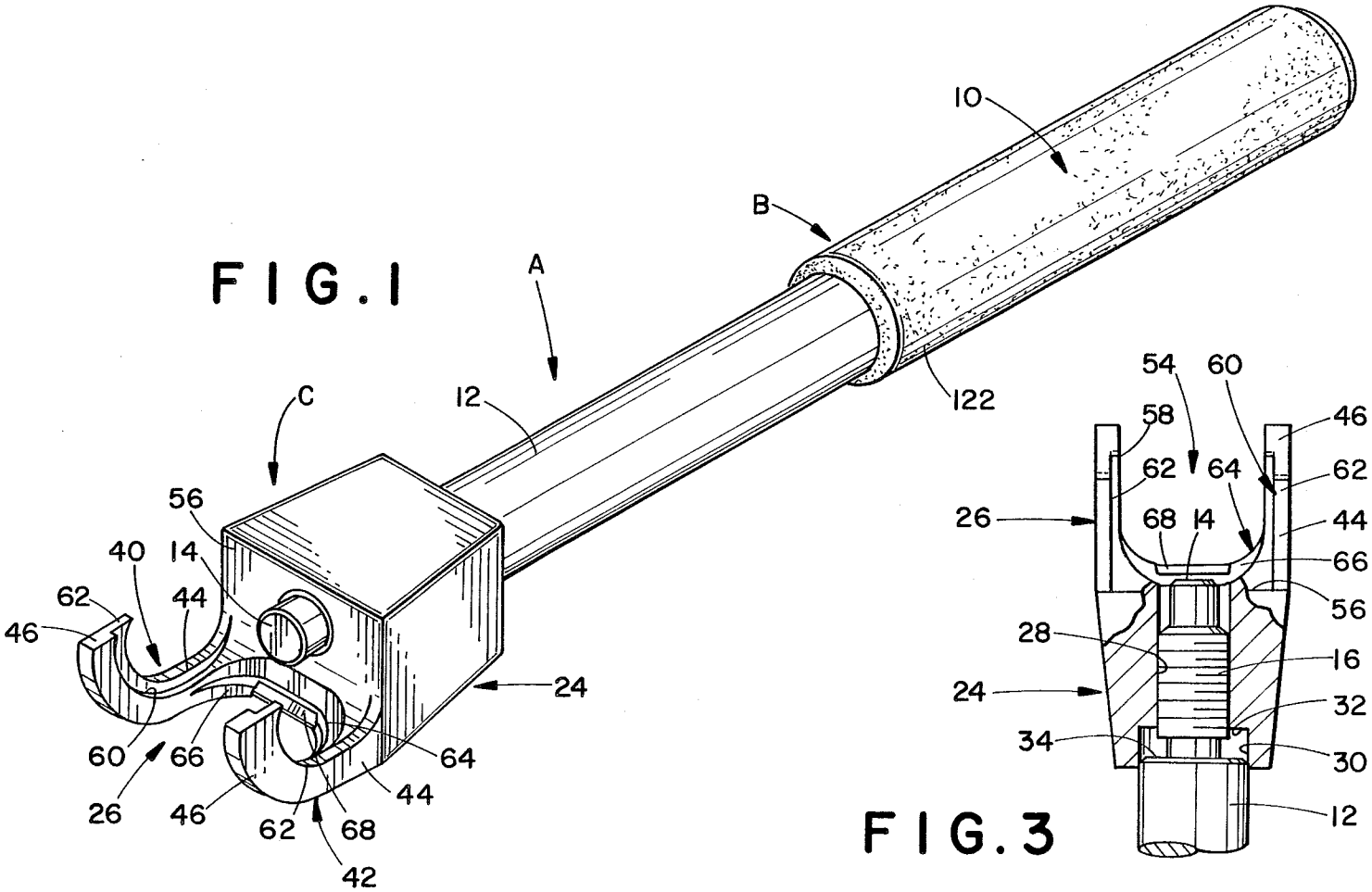
FIG. 1 is a perspective view of a wrench formed in accordance with the subject invention.
FIG. 3 is a partial plan view of the wrench as it is shown in FIG. 1 with a portion of the wrench body broken away for ease of illustration.

Referring now to the drawings wherein the showings are for purposes of illustrating the preferred embodiment of the invention only, and not for purposes of limiting same, the FIGS. show an adjustable wrench A having a handle B and a body member C. A portion of the body member is adapted to securely receive an associated fluid fitting D upon selective rotation of the handle relative to the body member. This provides a secure, clamping engagement of the fluid fitting to assist in adjustment of coupling nuts received on the fluid fitting.

Figure 2:
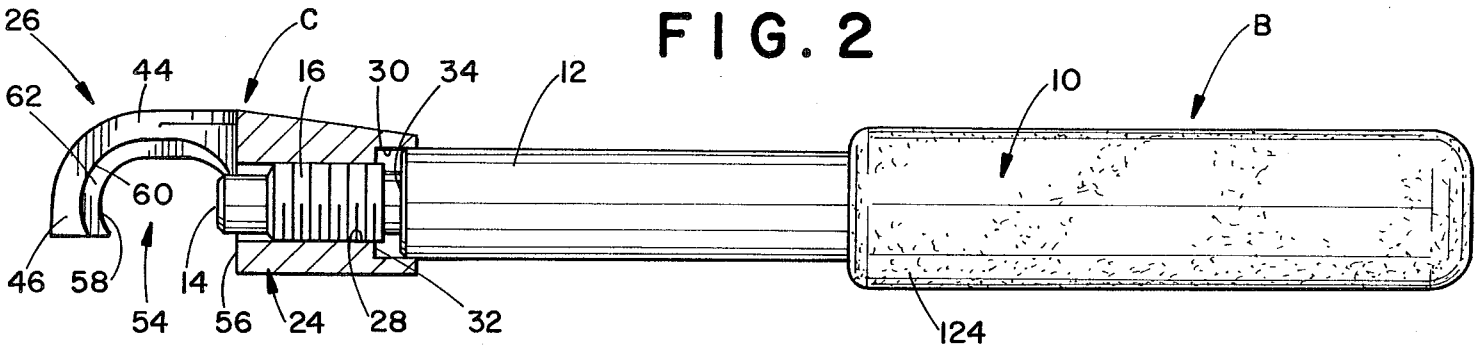
FIG. 2 is a side elevational view of the new wrench with the wrench body being shown in longitudinal cross-section for ease of illustration.

More specifically, and with reference to FIGS. 1–3, handle B of the subject new wrench is of a generally elongated, shaft-like conformation having a first or actuating end 10 and an opposed second or clamping end 12. The handle is of generally constant dimension and is adapted for relative rotary movement about its longitudinal axis with respect to body member C. The clamping end 12 has a generally smooth end face 14 dimensioned for clamping engagement with various sizes of fluid fittings. As will become more apparent below, the smooth end face is adapted for abutment with a planar portion of the associated fluid fitting D. The clamping end 12 of the handle has an externally threaded region 16 of reduced diameter along a limited, axial portion thereof. The reduced diameter region is adapted for cooperable receipt in body member C as will become more apparent hereinbelow.

The body member has two distinct regions 24, 26, the former of which includes an internally threaded bore 28 which threadedly receives the reduced diameter threaded portion 16 of the handle. Selective rotation of the handle in one direction or the other axially advances or retracts the handle relative to the body member. Specifically, smooth end face 14 is effectively advanced and retracted into and out of clamping engagement with the associated fluid fitting D. According to the preferred embodiment, a counterbore 30 extends axially inward into the first region 24 from one end of the body member to define a radial stop limit surface 32. This stop limit surface 32 cooperates with a shoulder 34 defined at the interface of the threaded portion 16 with the remainder of the handle. Abutting engagement between the stop limit surface 32 and shoulder 34 limits further axial advancement of the smooth end face 14 into second region 26.

Figure 4:
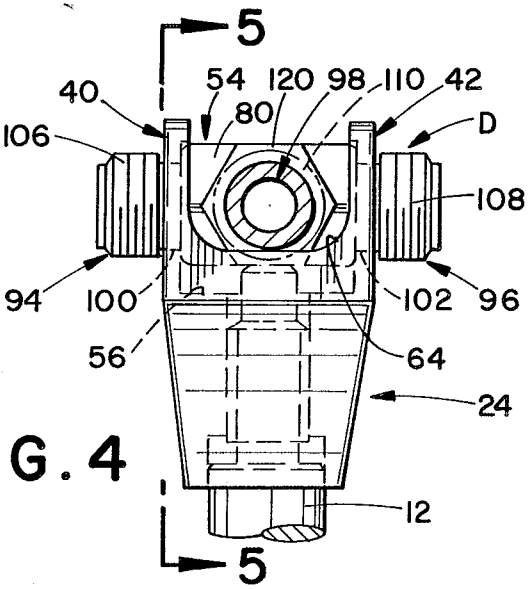
FIG. 4 is a partial plan view of the wrench as it is shown in FIG. 2 illustrating the manner of clamping association with a tee type fluid fitting.

As particularly shown in FIGS. 3 and 4, the first region 24 of the body member includes peripheral faces tapering outwardly toward the second region 26 to add rigidity to the body member C. Further, the body member first region 24 is substantially solid to provide sufficient "bulk" to the wrench structure. The second region includes parallel, generally L-shaped members 40, 42. These members are generally identical and each includes a first leg 44 extending contiguously from the first region 24 of the body member. A second leg 46 is disposed in generally perpendicular relation to the first leg. The second leg of each member 40, 42 has a generally curvilinear conformation adapted for securely engaging an associated fitting as will be described in greater detail below.

More specifically, the L-shaped members define opposed sidewalls of a central clamping cavity 54 adapted to freely receive an associated fluid fitting therein (FIG. 2). The first region 24 of the body member defines a fist end wall 56 of the clamping cavity. At the other end of the cavity, L-shaped members 40, 42, specifically the second leg portions thereof, define a second end wall 58. The end walls 56, 58 have generally curvilinear surfaces adapted to facilitate receipt of the associated fitting D. Typically, portions of the fluid fitting peripheral surface are generally curvilinear to accommodate the fluid conduits as will become more apparent below. Further, each of members 40, 42 includes a recessed portion 60 extending inwardly into its respective L-shaped member along its entire axial length. In this manner, a lip 62 is defined on each member 40, 42.

An axially extending cutout region 64 (FIGS. 1 and 3) is adapted to receive an orthogonal branch of the fluid fitting D. Further, a lip 66 is defined at the inner end area of region 64 by an arcuate relief area 68 extending into the body member first region 24 at end wall 56. Lip 66 is adapted for abutting engagement with a necked-down portion of the fluid fitting orthogonal branch as will be described below.

Figure 5:
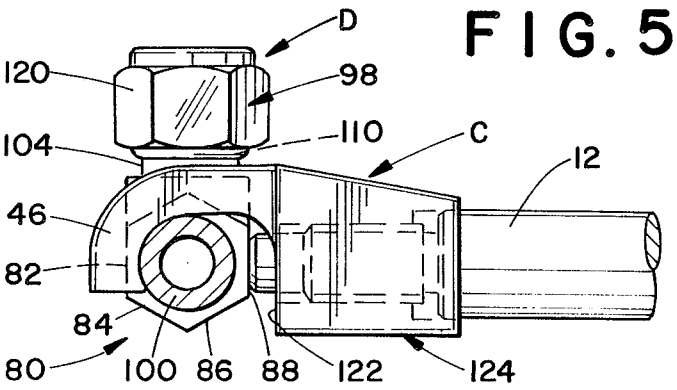
FIG. 5 is a partial side elevational view similar to FIG. 2 further illustrating clamping association with a tee type fitting.

Referring now to FIGS. 4 and 5, the fluid fitting D has a central body portion 80 that includes generally planar surface portions 82, 84, 86, and 88. These planar portions are oftentimes referred to as wrench flats for receiving a conventional open-ended wrench as detailed above in the discussion of the prior art. The body portion 80 illustrated in FIG. 5 is hexagonal; however, it will be appreciated by those skilled in the art that the wrench is equally useful with fitting body portions of other conformations, e.g., square, octagonal, etc.

The fitting body portion 80 includes first and second branches 94, 96 extending outwardly therefrom. These branches are illustrated in FIG. 4 and are disposed substantially coaxial to each other. A third branch 98 may be orthogonally arranged to define a tee type fitting. Of course, it will be understood by one of ordinary skill in the art that a fourth branch (not shown) may be disposed generally coaxial with the third branch 98. Such an arrangement is conventionally termed a cross type fitting.

The first, second, and third branches each include necked-down portions 100, 102, 104, respectively, immediately adjacent the fitting body portion 80. Each necked-down portion 100, 102, 104 is interposed between the body portion 80 and externally threaded regions 106, 108, 110, respectively. The externally threaded regions are cooperable with conventional coupling nuts 120 as is well known in the art and illustrated in FIG. 5. Additionally, and as is also known in the art, a ferrule (not shown) is often disposed between the branches and associated coupling nuts. A fluid contact extends into each branch and is sealingly retained therein by the cooperating ferrule and coupling nut assembly. Since such structures are known in the art and do not themselves form a part of the present invention, further discussion thereof is deemed unnecessary to a full and complete understanding of the subject new and improved wrench.

As indicated above, the third branch 98 of the fluid fitting is received in the cutout region 64 of the body member second region 26. More particularly, with the smooth end face 14 of the handle retracted from the clamping cavity, lip 66 of the cutout region is received against necked down portion 104. This defines one point of an associated four point contact with the fluid fitting. Likewise, lips 62 of each L-shaped member 40, 42 extend into abutting engagement with associated necked-down portions 100, 102 of the fitting first and second branches. The dimension defined between the lips 62 of the side walls is designed to accommodate the spacing between the necked down portions of coaxial branches 94, 96. The predetermined lateral dimension and receipt of the lips in respective necked down portions 100, 102 limit movement of the fitting along a lateral axis generally perpendicular to the axis of the handle. Lastly, planar surface portion 88 of the fluid fitting body 86 is engaged by smooth end face 14 as the handle is rotated and thus axially advanced into the clamping cavity 54.

Preferably, the longitudinal axis of the handle is disposed so that it intersects the trisection point of the first, second, and third branches 94, 96, and 98 when the fitting is received in the clamping cavity 54. Thus, end face 14 clamps the fluid fitting against lip regions 62 of the L-shaped members 40, 42 to prevent movement of the fluid fitting along an axis generally parallel to the longitudinal axis of the handle. Lip 66 extends into necked-down portion 104 of the third branch to limit rotational movement of the fluid fitting relative to the wrench body member. The clamping force imposed by the end face 14 and lip regions 62 on the fitting also assists in limiting rotation of the fitting about the axis defined through branches 94, 96. Lip portions 62 extend in abutting engagement with the necked-down portions 100, 102 along an arc length defined by approximatley 90 degrees (FIG. 5) to limit any movement of the fitting relative to the wrench in a direction parallel to the axis defined through the branches 94, 96. In this manner, the fluid fitting is braced against axial, lateral, and rotational movement relative to the wrench. Of course, this is a preferred position of the fluid fitting within the clamping cavity. It is readily understood that the fluid fitting can be fixedly retained in the clamping cavity at a variety of angular or rotated positions about coaxial branches 94, 96, limited by abutment between the orthogonal third branch 98 with the lip 66 or with body member edge 122 (FIG. 5). The end face 14 will cooperate with the various planar surface portions 82, 84, 86, and 88 so that the fitting may be clamped from a variety of angles.

With reference again to FIGS. 1 and 2, the actuating end 10 of the handle includes a torque limiting grip 124. The torque limiting grip has a generally sleeve-like configuration and transfers torque imposed thereon to the actuating end of the handle. Once the end face 14 has been moved into position for securely retaining the fluid fitting in the clamping cavity, further rotational forces would be unnecessary. With the subject invention, however, the grip slips relative to the remainder of the handle actuating end at some predetermined torque limit to prevent overtightening to the fitting. Adjustment of the predetermined torque required to obtain slippage between the grip and handle can be obtained by varying the material properties of the grip as will be understood by one skilled in the art.

In operation, the adjustable wrench A is positioned around an associated fluid fitting so that the first and second branches 94, 96 are received in the L-shaped members 40, 42 with the third branch 98 preferably being received in cutout region 64. The end face 14 of the handle is axially advanced toward the body portion of the fluid fitting until the fitting is clampingly engaged therein. This, then, allows a user to securely brace the fitting against movement by holding the actuating end 10 of the wrench. The second hand of the user employs a conventional open-ended wrench or the like to loosen or tighten the coupling nuts 120 as necessary and/or desired to allow coupling or uncoupling of fluid conduits with the fitting branches. Once the coupling nuts have been appropriately adjusted, the handle is rotated in the opposite direction to axially retract the end face 14 from clamping engagement with the fluid fitting and thereby allow the wrench to be removed for use elsewhere.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. An adjustable wrench for particular use with tee and cross type fittings having first, second, and third branches, the third branch being orthogonally disposed relative to the first and second branches, said wrench adapted to retainingly grasp a fitting during operative adjustment of coupling members associated with the branches of the fitting, said wrench comprising:

a handle having a first actuating end and a second clamping end terminating in a generally smooth end face; and, a body member adapted to receive an associated fitting therein, said body member having (i) a base portion having an end wall and cooperatively receiving said handle second end, said handle being movable along a first axis relative to said base portion for selectively extending and retracting said handle second end from said base portion end wall, (ii) a clamping portion extending outwardly from said base portion end wall defining a generally open clamping cavity, said clamping portion including first and second generally parallel spaced sidewall members, each member being generally L-shaped with a first leg extending generally parallel to the first axis and having a recessed region adapted to receive a peripheral portion of the associated fitting, each member further including a second leg disposed generally perpendicular to the first leg, and generally parallel to said base portion end wall to define a second end wall, each second leg having a generally curvilinear surface adapted to facilitate abutting receipt of the first and second branches of the associated fluid fitting and each second leg extending outwardly from a respective first leg to an opposite side of the first axis from the first legs, said clamping portion further including an arcuate cutout region extending axially outward from said base portion end wall from between said sidewall members for abutting engagement with the third branch of the associated fluid fitting, said arcuate cutout region being disposed axially outward a predetermined dimension from said base portion to orient the third branch of the associated fluid fitting in substantially perpendicular relation to the first axis, said handle clamping end adapted to be selectively placed in clamping engagement with the associated fitting body by selectively extending said smooth end face from said base portion end wall to define four point contact with the associated fluid fitting that limits movement of the associated fluid fitting along the first axis and limits rotational movement of the associated fluid fitting relative to the body member.

2. The wrench as defined in claim 1 further comprising means for limiting clamping forces operatively associated with said handle.

3. The wrench as defined in claim 2 wherein said limiting means includes a torque limiting member associated with said handle actuating end.

4. The wrench as defined in claim 2 wherein said handle is rotatable about the first axis to obtain axial movement thereof relative to said base portion, said limiting means including a handle grip received on said handle actuating end adapted for selective rotation relative thereto at some predetermined torque level therebetween.

5. The wrench as defined in claim 1 wherein said first and second sidewalls have a predetermined contour adapted to grip a peripheral arc length portion of the associated fitting defined by an angle approximating 90 degrees.

6. The wrench as claimed in claim 1 wherein said handle and body member have cooperating threaded regions for accommodating relative movement therebetween.

7. The wrench as defined in claim 1 wherein the first axis of the handle intersects a trisection point of the first, second, and third branches of the associated fitting.

* * * * *